US005476213A

United States Patent [19]

Suski

[11] Patent Number: 5,476,213

[45] Date of Patent: Dec. 19, 1995

[54] CONTAINER HAVING ABUSE RESISTANT END SEAL

[75] Inventor: William C. Suski, Hartsville, S.C.

[73] Assignee: Sonoco Products Company, Hartsville, S.C.

[21] Appl. No.: 459,295

[22] Filed: Jun. 2, 1995

Related U.S. Application Data

[63] Continuation of Ser. No. 281,433, Jul. 27, 1994, abandoned.

[51] Int. Cl.[6] ..... B65D 3/14

[52] U.S. Cl. ..... 229/5.5; 220/612; 220/620; 220/624; 229/400

[58] Field of Search ..... 229/3.1, 4.5, 5.5, 229/5.6, 400; 220/610, 612, 624, 453, 461, 614, 615, 620

[56] References Cited

U.S. PATENT DOCUMENTS

| | | | |
|---|---|---|---|
| 1,716,965 | 6/1929 | Lenderking | 229/5.6 |
| 2,085,847 | 7/1937 | Carew | 229/5.6 |
| 2,176,950 | 10/1939 | Aument | 229/5.6 |
| 2,276,578 | 3/1942 | Hahn | 229/5.6 |
| 2,970,736 | 2/1961 | Baughan . | |
| 3,137,431 | 6/1964 | Crouse et al. . | |
| 3,137,432 | 6/1964 | Rein et al. . | |
| 3,182,882 | 5/1965 | Aellen, Jr. et al. . | |
| 3,469,507 | 9/1969 | West | 229/5.6 X |
| 3,912,154 | 10/1975 | Godar | 229/5.5 |
| 3,949,927 | 4/1976 | Smith et al. . | |
| 4,190,189 | 2/1980 | DeForest . | |
| 4,289,265 | 9/1981 | Ellerbrock . | |
| 4,303,190 | 12/1981 | Ditto et al. . | |
| 4,525,396 | 6/1985 | Takasa et al. . | |
| 5,288,010 | 2/1994 | Kleemola et al. | 229/5.5 |

*Primary Examiner*—Allan N. Shoap
*Assistant Examiner*—Christopher J. McDonald
*Attorney, Agent, or Firm*—Bell, Seltzer, Park & Gibson

[57] ABSTRACT

A container is provided which includes a tubular-shaped body member and a generally cup-shaped end member positioned within the body member and wherein the body member includes a generally inwardly-curled U-shaped cross-sectional configured end which receives an outwardly extending flange portion of the cup-shaped end member. The end member and the body member of the container include barrier liner layers wherein barrier liner layer of the tubular body member is positioned on the inside thereof and the barrier liner layer of the cup-shaped end member is positioned on the inside of the cup-shaped member so that these barrier liner layers are in face-to-face position on the inside of the cup-shaped end member. A bond is created between these face-to-face positioned barrier liner layers only to cooperate therewith to seal the one end of the container against leakage. No bond is created in the area between the outside of the end member flange portion and the body member U-shaped cross-sectional configured end to allow flexing of the end member and the portion of the body member U-shaped cross-sectional configured end bonded thereto without tearing of the body member barrier liner layer and compromising the seal at the one end of the container.

3 Claims, 2 Drawing Sheets

CONTAINER HAVING ABUSE RESISTANT END SEAL

This application is a continuation of application Ser. No. 08/281,433, filed Jul. 27, 1994, now abandoned.

FIELD OF THE INVENTION

This invention relates to a container for packaging various products, particularly food products, and which is characterized by having an abuse resistant end seal which allows outward flexing of an end member without compromising the seal at the end of the container which might occur during dropping of the container or otherwise causing an internal force on the end member of the container.

BACKGROUND AND SUMMARY OF THE INVENTION

Paper containers having barrier liner layers and closed by paper end members also having barrier liner layers for packaging various products, including food products, constitute a significant commercial consumer product.

These prior containers, as illustrated in FIGS. 4 and 5 of the drawings and generally designated at 10, conventionally include a generally tubular-shaped body member 12 having opposed ends 13 and including a paperboard layer 14 and a barrier liner layer 15. The tubular body member 12 may be formed by spiral or convolute winding of the layers 14, 15. This prior container 10 further includes a generally cup-shaped end member 20 having a radially-extending central portion 21 of generally the same configuration and dimensions as one of the ends 13 of the body member 12 and an axially-extending flange portion 22 around the outside of the central portion 21. This end member 20 also conventionally includes a paperboard layer 24 and a barrier liner layer 25 positioned on the outside of the cup-shaped end member so as to be positioned inside the container when the end member 20 is positioned within one end 13 of the tubular body member 12.

In these prior containers 10, the end member 20 is positioned in one end 13 of the tubular body member 12 with the flange portion 22 extending outwardly of the body member. The end 13 of the tubular body member 12 is inwardly-curled into a generally U-shaped cross sectional configuration around the outwardly-extending flange portion 22 of the end member 20. In this position, the barrier layer 25 of the end member 20 is in face-to-face position with the barrier layer 15 of the body member 12 on the outside of the cup-shaped end member 20. Bonding means 30 is positioned between the barrier liner layers 15, 25 in face-to-face relation on the outside of the cup-shaped end member 20. Bonding means 31 is positioned between the inside of the flange portion 22 of the end member 20 and the inside of the U-shaped configured end 13 of the body member 12. Both bonding means 30, 31 cooperate with the barrier liner layers 15, 25 to seal the one end of the container against leakage.

While this prior construction of a container 10 provided a sufficient seal at the end 13 of the body member 12 by the end member 20, problems were present with breaking of the seal if the container 10 is dropped or other abuse is caused to the container which creates an internal force in the direction of the arrow shown in FIG. 5. When this internal force is created, the end member 20 will be flexed downwardly relative to the body member 12 causing a rupture or tearing of the liner layer 15 of the body member 12 where it is bonded to the liner layer 25 of the end member 20 since the bonding means is stronger than the barrier liner layers. This compromises the seal in the one end 13 of the tubular body member 12 of the container 10 and thus allows undesirable leakage of the contents of the container.

OBJECT AND SUMMARY OF THE INVENTION

Accordingly, it is the object of this invention to overcome the above discussed problem and to provide an abuse resistant end seal in a container of the type described which will prevent compromising of the seal at the end of the container which might occur during dropping of the container or otherwise causing an internal force on the end member of the container.

By this invention, it has been found that the above object may be accomplished by reversing the position of the barrier liner layer of the cup-shaped end member to position such barrier liner layer inside the end member so that when the end member is positioned in one end of the tubular-shaped body member of the container with its flange portion positioned within the U-shaped cross-sectional configured end, the end member barrier liner layer of the flange portion will be in face-to-face position with the barrier liner layer on the inside of the cup-shaped end member, rather than on the outside. Bonding means is then positioned only between the barrier liner layers in face-to-face position and the area between the outside of the end member flange portion and the body member U-shaped cross-sectional configured end is free of bonding means to allow outward flexing of the end member and the portion of the body member U-shaped cross-sectional configured end bonded thereto without tearing of the body member barrier liner layer and compromising the seal at the end of the container.

Preferably, sealing means, which may be in the form of a hot melt adhesive, is positioned within the body member U-shaped cross-sectional configured end and around the end of the end member flange portion for acting as an anti-wicking barrier and for aiding in sealing the one end of the container.

BRIEF DESCRIPTION OF THE DRAWINGS

In the drawings which form part of the original disclosure of the invention.

DETAILED DESCRIPTION OF A PREFERRED EMBODIMENT OF THE INVENTION

In the following detailed description, a preferred embodiment of the invention is described. It will be understood, however, that the invention is not to be limited to its preferred embodiment and although specific terms are employed in describing this preferred embodiment, these are for purposes of illustration only and not for purposes of limitation. It will thus be apparent that the invention includes various alternatives, modifications and equivalents within the spirit and scope as will be apparent to skilled artisan.

Figure 1:
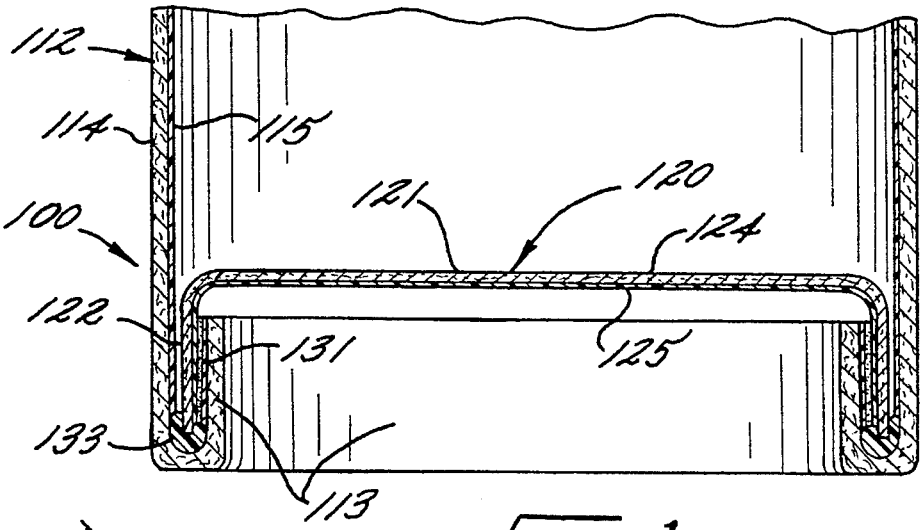
FIG. 1 is a sectional view through one end of a container constructed in accordance with this invention and having an abuse resistant end seal.
Figure 2:
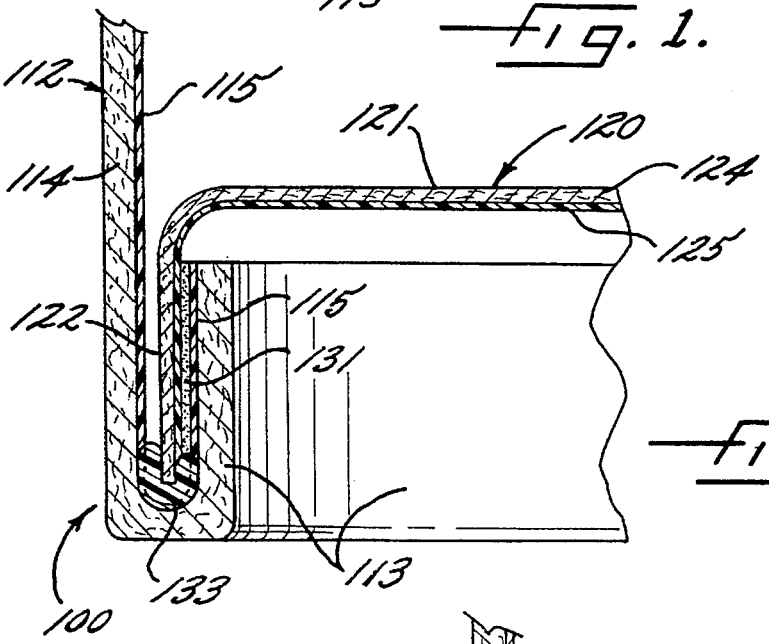
FIG. 2 is an enlarged partial sectional view of one side of the end of the container of FIG. 1.

FIGS. 1 and 2 illustrate a preferred embodiment of a container, generally referred to at 100, constructed in accordance with the present invention. This container includes a generally tubular-shaped body member 112 having opposed ends 113. The tubular-shaped body member 112 includes a paperboard layer 114 and a barrier liner layer 115 in superimposed position inside the paperboard layer 114. At least one end 113 of the tubular body member 112 of the container 10 is disposed in a generally inwardly-curled U-shaped cross-sectional configuration. The paperboard layer 114 and the barrier liner layer 115 may be formed into the generally tubular-shaped body member 112 by spiral, convolute or other suitable winding processes.

The paperboard layer 114 may be composed of conventional spiral-winding paperboard or board stock having a thickness of between about 0.010 and 0.042 inch, preferably between about 0.015 and 0.030 inch, for example 0.021 inch. The barrier liner layer 115 may advantageously comprise a flexible material such as a polymer, a metalized polymer, a silicate impregnated polymer, or a lamination of property enhancing polymers, or polymer coatings on polymers, foils or paper, laminations of paper, metalized paper, polymer, metalized polymer, silicate impregnated polymer or foil engineered in combination to achieve the desired level of barrier.

The container 100 in accordance with this invention further includes a generally cup-shaped end member 120 having a radially-extending central portion 121 of generally the same configuration and dimensions as the one end 113 of the body member 112 and an axially-extending flange portion 122 around the outside of the central portion 121. The end member 120 includes a paperboard layer 124 and a barrier liner layer 125 in superimposed position with the paperboard layer inside the cup-shaped end member 120. The paperboard layer 124 and the barrier liner layer 125 may advantageously be constructed of the same material set forth above with respect to these layers in the tubular body member 112.

Figure 3:
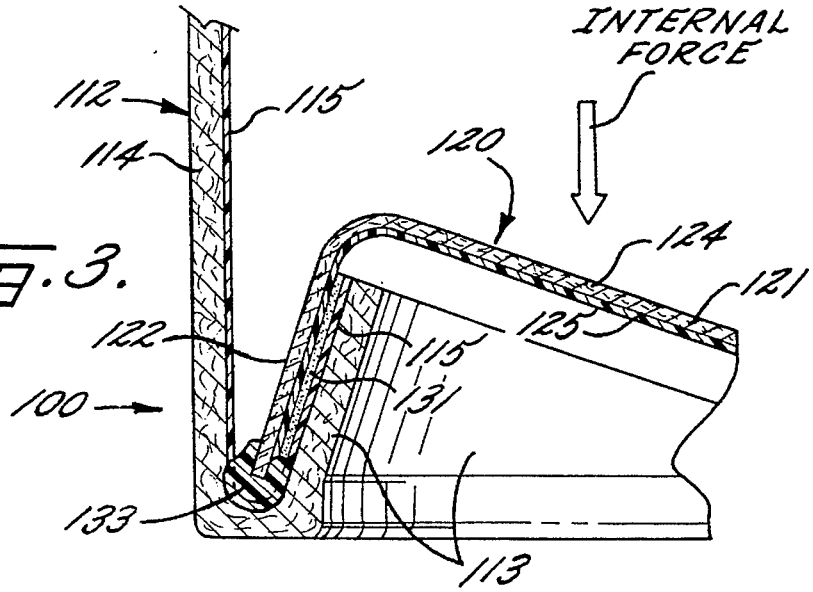
FIG. 3 is a view, like FIG. 2, showing downward flexing of an end member of the container caused by an internal force.
Figure 4:
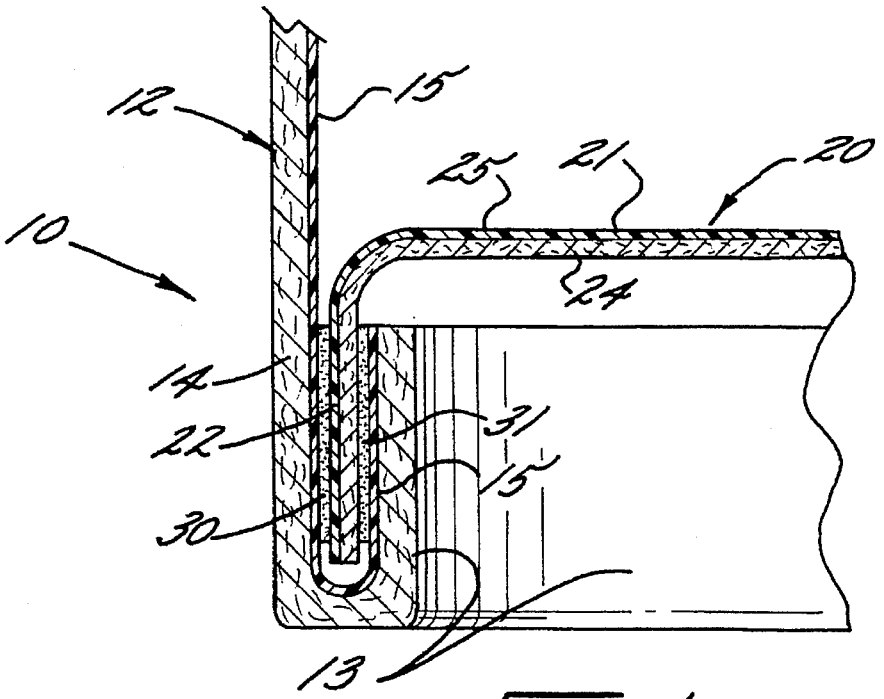
Fig. 4. (PRIOR ART)
FIG. 4 is a view, like FIG. 2, of a container constructed in accordance with the prior art and described above.
Figure 5:
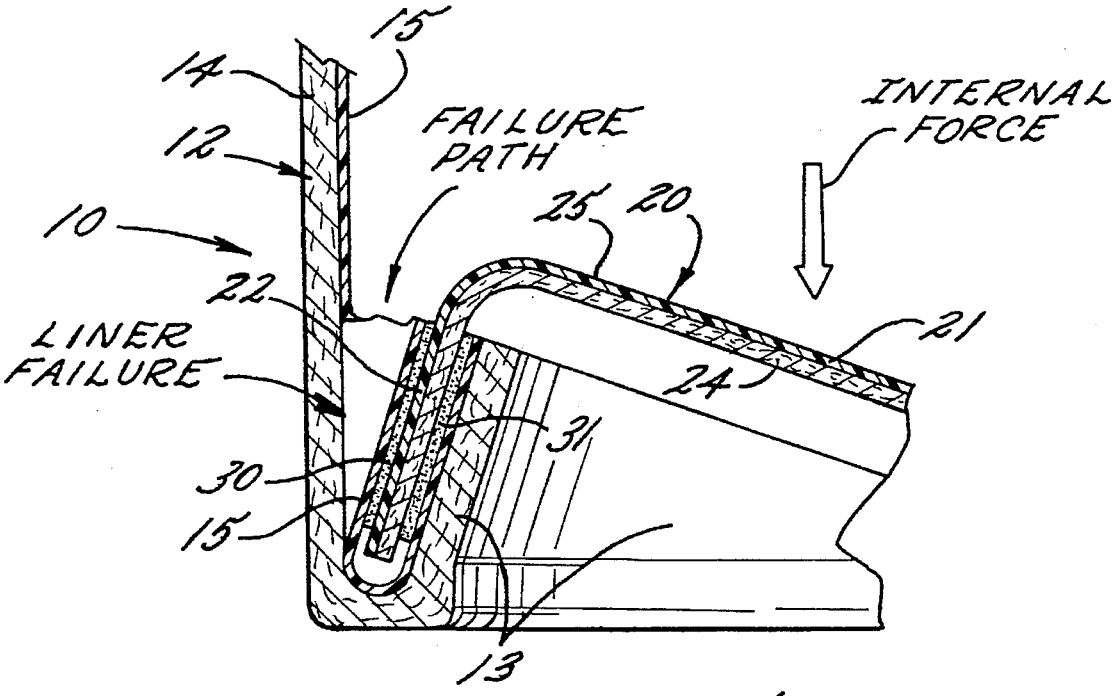
Fig. 5. (PRIOR ART)
FIG. 5 is a view, like FIG. 3, showing the effects of internal force on the end member of a container constructed in accordance with the prior art as described above.

The end member 120 is positioned in one end of the tubular body member 112 for closure thereof with the flange portion 122 extending outwardly of the body member 112 and positioned within the U-shaped cross-sectional configured end 113 to place the end member barrier liner layer 125 of the flange portion 122 in face-to-face position with the body member barrier liner layer 115 on the inside of the cup-shaped end member 120. Bonding means 131 is positioned between the barrier liner layers 115, 125 in face-to-face position for bonding the end member 120 to the body member 112 and for cooperating with the barrier liner layers 115, 125 to seal the one end of the container against leakage. The area between the outside of the end member flange portion 122 and the body member U-shaped cross-sectional configured end 113 or the area between the paperboard layer 124 in the flange portion 122 of the end member 120 and the barrier liner layer 115 of the body member 112 in the U-shaped configured end 113 is free of any bonding means to allow outward flexing of the end member 120 and the portion of the body member U-shaped cross-sectional configured end 113 bonded thereto without tearing of the body member barrier liner layer 115 and compromising the seal at the one end of the container, as shown in FIG. 3.

Preferably, a sealing means 133 is positioned within the body member U-shaped cross-sectional configured end 113 and around the end of the end member flange portion 122 for acting as an anti-wicking barrier and for aiding in sealing the one end 113 of the container 100.

The bonding means positioned between the barrier liner layers 115, 125 on the inside of the outwardly extending end member flange portion 122 and the inside of the U-shaped configured end 113 of the body member 112 may advantageously comprise a heat seal or may utilize a suitable adhesive including a hot melt adhesive, all of which are well known to those with ordinary skill in the art and available from a number of suppliers. The sealing means 133 positioned within the body member U-shaped cross-sectional configured end 113 and around the end of the end member flange portion 122 for acting as an anti-wicking barrier and for aiding in sealing the one end 113 of the container 100 may advantageously comprise a hot melt adhesive.

Thus, it may be seen, that a container 100 has been provided for packaging various products, particularly food products, which is characterized by having an abuse resistant end seal which allows outward flexing of an end member 120 without compromising the seal at the end of the container 100 which might occur during dropping of the container 100 or otherwise causing an internal force on the end member of the container 100.

This invention has been described in considerable detail with reference to its preferred embodiments. However, variations and modification can be made within the spirit and scope of the invention as described in the foregoing specification and as defined in the following claims.

What is claimed is:

1. A container having an abuse resistant end seal and particularly adapted for packaging food products and comprising:

a generally tubular-shaped body member having opposed ends and including a paperboard layer and a barrier liner layer in superimposed position inside said paperboard layer, at least one end of said tubular container having said paperboard layer and said barrier liner layer disposed in a generally inwardly-curled U-shaped cross-sectional configuration;

a generally cup-shaped end member having a radially-extending central portion of generally the same configuration and dimensions as said one end of said body member and an axially-extending flange portion around the outside of said central portion, said end member including a paperboard layer and a barrier liner layer in superimposed position with said paperboard layer inside said cup-shaped end member, said end member being positioned in said one end of said tubular body member for closure thereof with said flange portion extending outwardly of said body member and positioned within said U-shaped cross-sectional configured end to place said end member barrier liner layer of said flange portion in face-to-face position with said body member barrier liner layer on the inside of said cup-shaped end member;

bonding means positioned between said barrier liner layers in face-to-face position for bonding said end member to said body member and for cooperating with said barrier liner layers to seal said one end of said container against leakage; and the area between the outside of said end member flange portion and said body member U-shaped cross-sectional configured end being free of bonding means to define flexing means for outward flexing of said end member and the portion of said body member U-shaped cross-sectional configured end bonded thereto without tearing of said body member barrier liner layer and compromising the seal at said one end of said container.

2. A container, as set forth in claim 1, further including sealing means positioned within said body member U-shaped cross-sectional configured end and around the end of said end member flange portion for acting as an anti-wicking barrier and for aiding in sealing said one end of said container.

3. A container, as set forth in claim 2, in which said sealing means comprises a hot melt adhesive.

* * * * *